United States Patent [19]

Fremund

[11] Patent Number: 5,076,783

[45] Date of Patent: Dec. 31, 1991

[54] SAFETY LIGHTER

[76] Inventor: Zdenek Fremund, 4 Surrey La., Montvale, N.J. 07645

[21] Appl. No.: 512,925

[22] Filed: Apr. 23, 1990

[51] Int. Cl.[5] ..... F23Q 25/00; F23D 11/36

[52] U.S. Cl. ..... 431/153; 222/153; 431/343

[58] Field of Search ..... 431/133, 135, 136, 137, 431/153, 141, 140, 138, 139, 144, 254, 267, 273, 274, 275, 276, 277, 343; 222/153, 402.11

[56] References Cited

U.S. PATENT DOCUMENTS

| | | | |
|---|---|---|---|
| 1,817,335 | 8/1931 | Aronson | 431/136 |
| 2,520,328 | 8/1950 | Nissen | 431/153 X |
| 3,547,566 | 12/1970 | Tamarin | 431/254 X |
| 4,901,848 | 2/1990 | Parren | 431/153 X |
| 4,921,420 | 5/1990 | Johnston | 431/153 |

FOREIGN PATENT DOCUMENTS

| | | | |
|---|---|---|---|
| 2210552 | 9/1973 | Fed. Rep. of Germany | 431/344 |
| 684904 | 12/1952 | United Kingdom | 431/137 |

*Primary Examiner*—Carl D. Price
*Attorney, Agent, or Firm*—Robert A. Green

[57] ABSTRACT

The disclosure is of a safety lighter including the usual lighter mechanism having a finger-operated activating lever which is coupled to a vertical rod which extends into the body of the lighter or a sleeve which encloses the lighter. The lower end of the vertical rod is coupled to apparatus which is operated by the user to permit the lighter to be operated once and then disabled.

7 Claims, 2 Drawing Sheets

SAFETY LIGHTER

BACKGROUND OF THE INVENTION

There are many safety lighters in the prior art which have different types of mechanisms adapted to render them safe or child proof. All of such lighters, while effect are relatively complex and would be expensive to manufacture. Perhaps this explains why there are no such safety lighters presently available on the market.

The present invention solves this problem and provides a safe lighter which is generally simple in construction and can be incorporated with ease in the lighter itself or in the sleeves in wide use for present day throwaway lighters.

DESCRIPTION OF THE INVENTION

Figure 1:
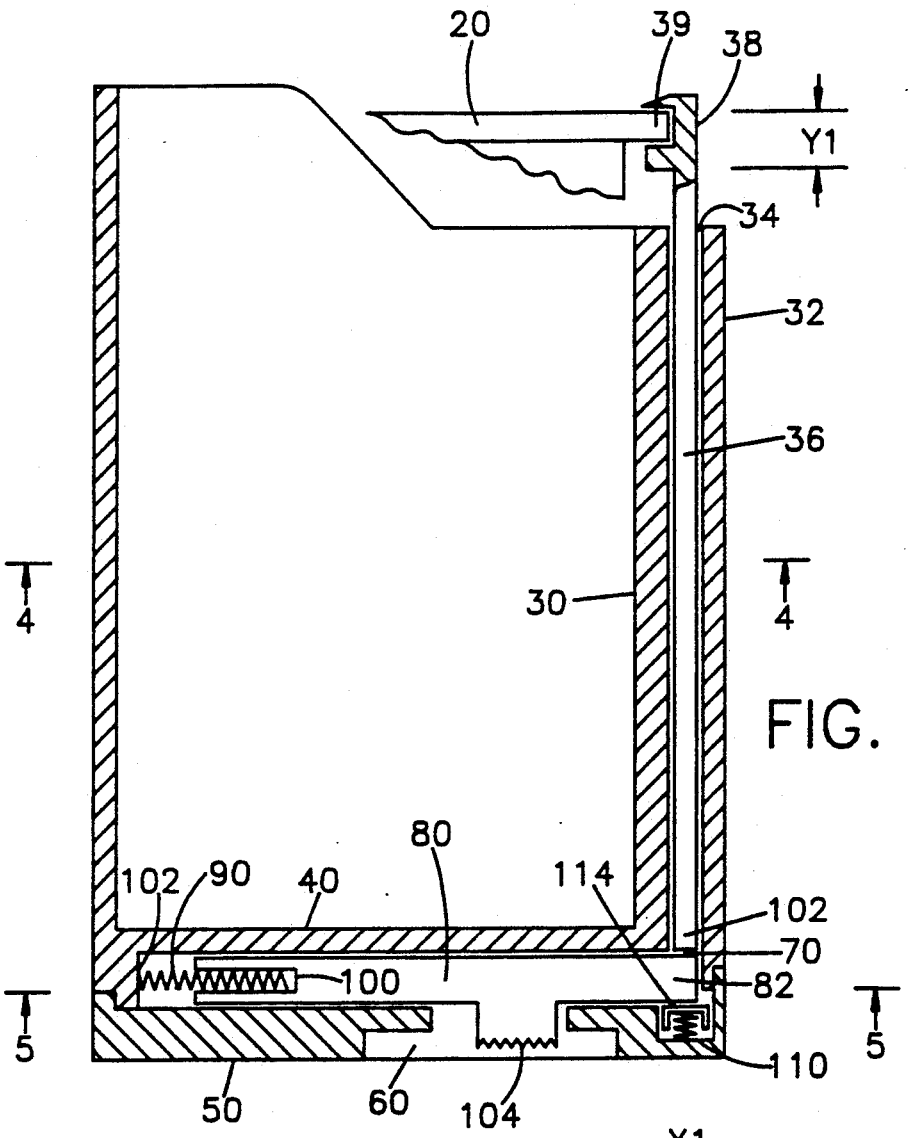
FIG. 1 is a side sectional elevational view of a lighter assembly embodying the invention.
Figure 2:
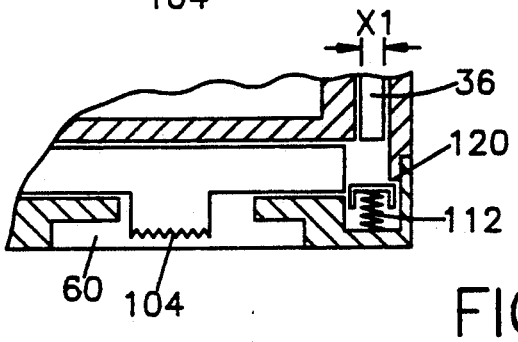
FIG. 2 is a enlarged sectional view of a portion of the lighter of FIG. 1 illustrating its operation.
Figure 3:
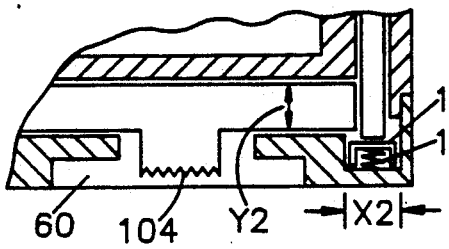
FIG. 3 is a view similar to that of FIG. 2 illustrating another step in the operation of the lighter of the invention.
Figure 4:
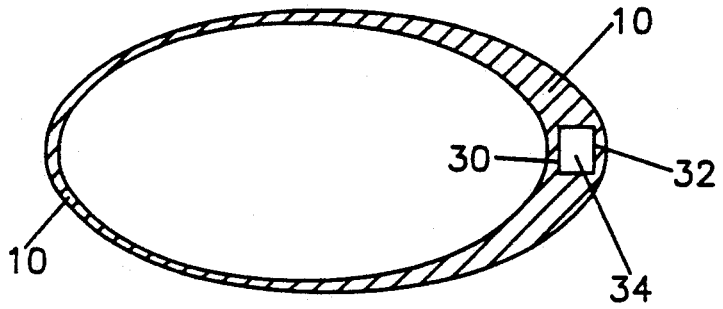
FIG. 4 is a sectional view along the lines 4—4 in FIG. 1.
Figure 5:
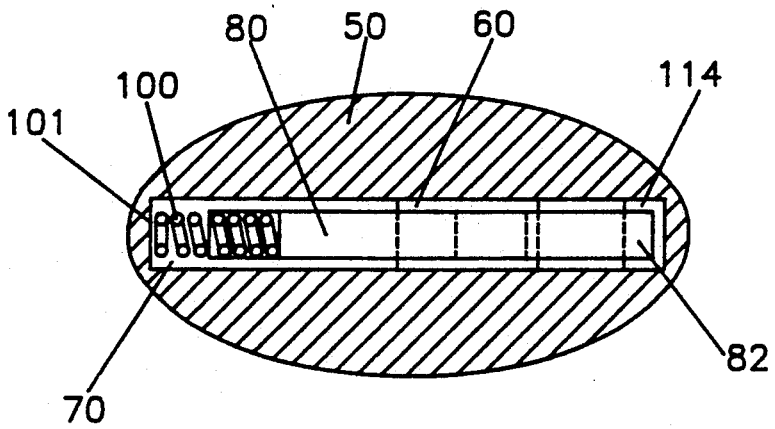
FIG. 5 is a sectional view along the lines 5—5 in FIG. 1.

Referring to FIG. 1, the apparatus shown is a sleeve 10 of the type widely used into which a throwaway lighter is slipped for decorative purposes. According to the invention, apparatus for rendering the lighter safe to use or safer to use than present day lighters, is incorporated in the body of the lighter or in a decorative sleeve for the lighter.

All of the operating apparatus of a lighter assembly 10 need not be shown to illustrate the principles of the invention. The actuating lever 20 of the lighter which is depressed by the user to ignite the lighter is shown.

The outer wall of the lighter or the sleeve into which the lighter is inserted is generally oval in cross section and includes a vertical hole 34 which extends from the upper end of the wall of the sleeve to the bottom thereof. A locking rod 36 is slidably seated in the vertical hole or space 34 and includes a U-shaped upper end 38 which is adapted to engage the lip 39 of the lighter's actuating lever 20.

The lighter assembly includes a horizontal floor or base wall 40 on which the bottom of the lighter rests if the lighter assembly includes a decorative sleeve. Spaced from the base wall 40 is an auxiliary horizontal base wall 50 which is provided with an opening 60 large enough for a purpose to be described.

In the space 70 between the walls 40 and 50, a horizontal chamber is formed which is wide enough to receive a locking slide member 80 which can slide freely in the space 70 but is held in place therein. The locking slide plate 80 has a U-shaped formation 90 in its left end and a return spring 100 is seated in this depression between the base of the depression and the wall 101 defining the left end of the space 70. The spring urges the slide plate 80 to the right as seen in the drawings. The right hand end 82 of the slide plate 80 lies just beneath the lower end 102 of the lighter actuating locking rod 36 when it is in its rightmost position.

The lower edge of the locking slide plate is provided with a serrated projection 104 which fits in the opening in the wall 50 and is accessible to the lighter user.

The right hand end of the wall 50, under the end 102 of the locking rod 36, is provided with a small circular depression 110 in which is seated a compression spring 112 for operation with the slide 80 and the locking rod 36. A latch plate 114 is seated oh the spring 112.

Normally, as seen in FIG. 1, when the lighter is not being used, the spring 90 has the locking slide 80 pushed to the right overlying the spring-loaded latch 114 and the lower end 102 of the locking rod 36 rests on the right hand end 82 of the locking slide 80 and it cannot be depressed and the lighter cannot be operated. When it is desired to use the lighter, the user pushes on the projection 104 on the locking slide 80 and pushes the locking slide to the left to free the latch 114 and actuating locking rod 36. The latch 114 hits a notch 120 on the inside of the outer wall of the lighter assembly and is in such a position that the slide 80 cannot move to the right. Now the user can operate the activating lever 20 and to light the lighter. When the lever 20 is compressed, the spring latch 114 is pushed dowm and the locking slide 80, whose end overlies slightly the spring-loaded latch 114, is pushed to the right to rest against the the locking rod 36. When the lighter actuating lever 20 returns, it pulls the locking rod 36 upwardly above the locking slide's right hand end 82. This allows the locking slide 80 to return, by the force of the spring 100, to its rightmost position and to lock the locking rod 36 again in the inoperative position.

It is noted that the actuating lever's operating stroke Y1 is greater than the locking slide's thickness Y2. Also, the locking rod's width X1 is smaller than the width X2 of the latch.

What is claimed is:

1. A cigarette lighter assembly comprising a sleeve having a wall and an open upper end for receiving lighter parts and having a closed lower end, lighter parts in said sleeve, an actuating lever comprising a portion of said lighter parts disposed within said sleeve, said actuating lever disposed at said open end of said sleeve, a vertical chamber adjacent to a portion of said wall of said sleeve, said vertical chamber including an open top adjacent said open upper end of said sleeve and a bottom end adjacent said lower end of said sleeve, a locking rod slidably disposed in said vertical chamber and having an upper end and a lower end, said locking rod including a depression in said upper end thereof for engaging a portion of said actuating lever, said lower end of said locking rod lying at said bottom end of said vertical chamber, a spring-biased locking slide slidably attached beneath the base of said sleeve and having an end disposed beneath said lower end of said locking rod to define a locked position for maintaining said actuating lever in a first locked position, said locking slide being normally biased so that said end of said locking slide lies beneath said locking rod and said locking slide thus prevents said locking rod from moving and prevents said actuating lever from being actuated, and means on said locking slide to permit the user to move said locking slide against its spring bias to free said locking rod and permit said locking rod to move from said first position toward said bottom end, the spring bias of said locking slide arranged to move said locking slide back under said locking rod to restore said locking rod to said locked position after said actuating lever is moved back to said first locked position.

2. The lighter assembly defined in claim 1 and including a spring-biased latch disposed beneath the end of said locking slide which lies adjacent to the lower end of said locking rod, said latch being operated when the locking rod is released to hold the locking slide out of engagement with said locking rod.

3. The lighter defined in claim 1 wherein said sleeve includes a second wall spaced from the base thereof, said bottom wall having an opening therein accessible to the exterior of said second wall, said second wall having a depression aligned with the lower end of said locking rod, a spring-biased latch plate in said depression in said second wall and operable to hold said locking slide away from the lower end of said locking rod when said locking rod is to be actuated to light the lighter, and a projection on said locking slide and positioned in said opening in said bottom wall and accessible to the user of the lighter.

4. A cigarette lighter assembly comprising a housing having an outer wall, an upper open end and a bottom wall, an operating mechanism of a lighter disposed within said housing and including an actuating lever operated by the user of the lighter to cause the lighter to ignite, said actuating lever including a portion disposed inside said housing adjacent to said outer wall, a vertical passage in said housing adjacent to a portion of said wall, said passage including an open top adjacent said upper open end of said housing and a bottom end adjacent said bottom wall of said housing, a locking rod slidably disposed in said vertical passage and having an upper end and a lower end, a catch means in the upper end of said locking rod adapted to receive a portion of said actuating lever, the lower end of said locking rod lying at said bottom of said vertical passage, a spring-biased locking slide slidably attached adjacent to said bottom wall and having an end disposed beneath said lower end of said locking rod, to define a locked position for maintaining said actuating lever in a first locked position, said locking slide being normally biased so that said end lies beneath said locking rod and prevents said locking rod from being operated and said actuating lever from being actuated, and means on said locking slide to permit the user to move said locking slide against its spring to free said locking rod and permit it to be operated to move from said first position toward said bottom wall, the spring bias of said locking slide arranged to move said locking slide back under said locking rod to restore said locking rod to said locked position in which it cannot move after said actuating lever is moved back to said first locked position.

5. The lighter assembly defined in claim 4 and including a spring-biased latch disposed beneath the end of said locking slide which lies adjacent to the lower end of said locking rod, said latch being operated when the locking rod is released to hold the locking slide out of engagement with said locking rod.

6. The lighter defined in claim 5 wherein said housing includes a second wall spaced from and beneath said bottom wall, said second wall having an opening therein accessible to the exterior of said second wall, said second wall having a depression aligned with the lower end of said locking rod, said spring-biased latch plate being seated in said depression in said second wall and operable to hold said locking slide away from the lower end of said locking rod when said locking rod is to be actuated to light the lighter, and a projection on said locking slide and positioned in said opening in said bottom wall and accessible to the user of the lighter.

7. The lighter defined in claim 6 wherein said latch plate comprises a generally U-shaped member seated on a spring in said depression in said second wall, said end of said locking slide normally being disposed between said lower end of said locking rod and said latch plate, and means in operative relation with said latch plate limiting the upward movement thereof when said locking slide is removed from beneath said locking rod.

* * * * *